US007111656B2

(12) United States Patent
Cureton

(10) Patent No.: US 7,111,656 B2
(45) Date of Patent: Sep. 26, 2006

(54) WOOD TECHNIQUE FOR CREATING AESTHETICALLY PLEASING DESIGNS

(76) Inventor: Curtis E. Cureton, 304 Seabright St., Pittsburgh, PA (US) 15214

( * ) Notice: Subject to any disclaimer, the term of this patent is extended or adjusted under 35 U.S.C. 154(b) by 271 days.

(21) Appl. No.: 10/736,132

(22) Filed: Dec. 15, 2003

(65) Prior Publication Data

US 2004/0250916 A1 Dec. 16, 2004

Related U.S. Application Data

(60) Provisional application No. 60/433,237, filed on Dec. 13, 2002.

(51) Int. Cl.
*B27M 1/00* (2006.01)
*B27M 3/00* (2006.01)

(52) U.S. Cl. ..... 144/364; 144/380

(58) Field of Classification Search ..... 144/359, 144/360, 363, 364, 380, 329; 156/153, 257; 427/271, 272, 317, 325, 429, 421.1, 428.01
See application file for complete search history.

(56) References Cited

U.S. PATENT DOCUMENTS 5,327,951 A * 7/1994 Pickle et al. ..... 144/358
5,435,770 A * 7/1995 Balentine ..... 451/31
5,484,495 A * 1/1996 Moore ..... 156/62

OTHER PUBLICATIONS

Woodburnging, Step by Step Instructions; L.S. Irish; http://www.carving_patterns.com.*

* cited by examiner

*Primary Examiner*—Derris H. Banks
*Assistant Examiner*—Shelley Self
(74) *Attorney, Agent, or Firm*—Robert D. Kucler; Reed Smith LLP

(57) ABSTRACT

A method for creating an aesthetically pleasing wood design. Generally, a design is transferred to a sanded and cleaned piece of porous wood, and the design is etched using one or more trenching techniques. Parts of the design are then burned using a heating element to impart various shades of darkness or shadow to the design. After burning, the design may be finished and/or colored with a paint, varnish, oil or other finishing material. More than one layer of finish is typically used, and a sanding step is used between successive finishing layers. After a final finishing step, the wood may be sealed or finished with, for example, polyurethane.

20 Claims, 7 Drawing Sheets
(7 of 7 Drawing Sheet(s) Filed in Color)

WOOD TECHNIQUE FOR CREATING AESTHETICALLY PLEASING DESIGNS

CLAIM OF PRIORITY

This application claims priority to U.S. Provisional Patent Application Ser. No. 60/433,237 filed on Dec. 13, 2002.

BACKGROUND OF THE INVENTION

1. Field of the Invention

The present invention relates generally to woodworking techniques, and, more specifically, the present invention is directed to methods for creating aesthetically pleasing designs in wood.

2. Description of the Background

There are many techniques, both traditional and modern, for creating various types of aesthetically pleasing designs in various mediums. Once created, these designs may be displayed in a central location to attract one's attention (e.g., art objects), or the designs may blend into the surrounding environment in a way that is pleasing to the senses in a less extroverted manner.

One broad type of aesthetically pleasing designs is woodcraft. Wood engraving, finishing and other woodworking arts have been used for generations to create both aesthetically pleasing and useful designs. For example, the wood has traditionally been carved, whittled, painted, and otherwise manipulated to transform the wood into unique deigns. Oftentimes, some combination of these techniques is used to create the artwork. The present invention extends the current knowledge and techniques in the woodworking area to create a specialized class of aesthetically pleasing designs.

SUMMARY OF THE INVENTION

In at least one preferred embodiment, the present invention provides a method for creating a specialized class of aesthetically pleasing designs in wood. Generally speaking, the method includes various steps of carving and finishing in a specific sequence to maximize the contrast and other aspects of the final wood design. Variations on this main theme are also included within the scope of the invention.

In brief, the method begins by selecting and sanding a porous piece of wood on at least one side. A design is then transferred to the surface of the wood and an initial carving or other indentation is performed using the design as a guide. Additional steps of rubbing the "trenched" surface with an eraser, tack cloth, and/or sand paper is then employed to smooth the surface of the design.

After smoothing, a heating element is preferably used to apply heat to areas of the design that are to be darkened, shadowed or shaded. The amount of heat determines the ultimate coloring and tint of the design. A tack cloth is then used to rub the surface.

Following the heating step alternate steps of applying stains, oils or varnishes followed by sanding steps are used to create the aesthetically pleasing design. These staining and sanding steps are alternated as many times as desired by the artist. A tack cloth may then be used for a final wipe down of the finished wood design.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

Figure 1:
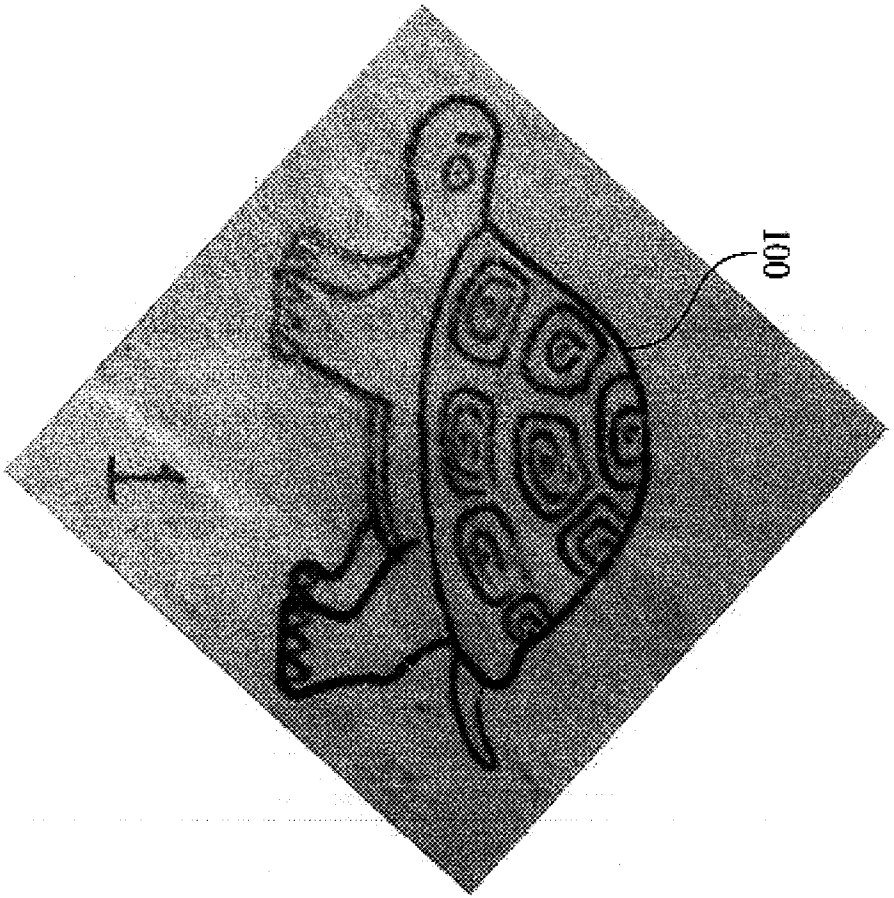
FIG. 1 shows a wood piece with an exemplary (turtle) design drawn thereon.

It is to be understood that the figures and descriptions of the present invention have been simplified to illustrate elements that are relevant for a clear understanding of the invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description will be provided hereinbelow with reference to the attached drawings.

The following methodology outlines at least one exemplary embodiment for creating aesthetically pleasing wood designs according to the present invention. Although several alternatives for each step in the method and each tool or other material are described, one skilled in the art could further extend the described embodiments within the teaching of the present disclosure. As such, the various embodiments described below, which are detailed with reference to the attached drawings, are exemplary in nature and should not be construed to limit any further claims drawn to the present subject matter in any way.

A preferred woodworking technique according to the present invention will now be described with respect to the following steps. Initially, (Step 1) the wood engraving method is preferably employed using a piece of porous wood of any shape or size. The desired outcome of the artwork is the determining factor when selecting the wood type and size. For example, any of a variety of wood types may be used including pine (soft), oak (hard), birch (hard), luana, or other porous woods. Experiments have shown that the technique produces works that appear to "darken" the wood; hence, the choice of wood should take this darkening effect into account.

(Step 2) After selecting the appropriate wood, clamps or other forms of vices are used to secure the wood to a level surface for further processing. For example, placing the wood on a flat and level surface provides for an even sanding application. After clamping, the entire piece of wood is then sanded on at least one, or more preferably both, broad face(s) of the wood. In one embodiment, the wood is lightly sanded to remove approximately 1/64" of the broad face surface of the wood. If sanding by hand, a #100 sand paper sufficiently prepares the surface for later processing. Likewise, a sanding machine using #100 paper is also an exemplary implementation. To most appropriately bring out the grain in the wood, the wood should be sanded in the direction of the grain. It is the later viewing of this grain through the added varnish that is one of the pleasing elements to the eye.

(Step 3) After sanding and examining the direction of the pattern of wood grain, the grain direction is used to determine the appropriate place for the design or shape to be developed. To print the design, a soft lead pencil or other marking implement is used to draw, print or copy a desired shape or design onto the surface of the wood to be engraved. During transfer, care should be taken not to mark the wood to heavily with transferring methods. In other embodiments, the design may be directly transferred on to the wood, including rub transfers, stenciling along with other known transfer techniques.

The shape and size of the design can be almost limitless, but preferably includes areas that will create an aesthetically pleasing contrast between adjacent sections of the design. FIG. 1 shows an exemplary piece of wood with the design of a turtle 100 that was drawn using a lead pencil. At this stage, the cleaned wood exists with the design 100 on the surface.

After the design is transferred to the wood, the wood should be engraved or otherwise indented using known techniques according to the design (Step 4). For example, a wood chisel, utility knife or small routing tool (such as a DREMEL brand tool) could be used to make a trench along the pattern that was transferred to the wood according to the above step. While using engraving tools or techniques, the woodworker must be aware of and take note of the wood grain pattern and design based on the type of wood surfaces (soft verses hard wood) engraving techniques.

Techniques will vary depending on hard verses soft wood surfaces. For example, if working with hard wood, more pressure is needed to rout the wood surface. In one embodiment, a groove is trenched along each of the pencil lines of the drawing. In other embodiments, some areas of the design may be completely routed to a certain depth, while other areas are grooved to various other depths. In an exemplary embodiment, the depth of the grooves is approximately 1 to 2 centimeters. It is this inconsistent nature of the groove that adds to the overall appearance of the work when completed.

Figure 2:
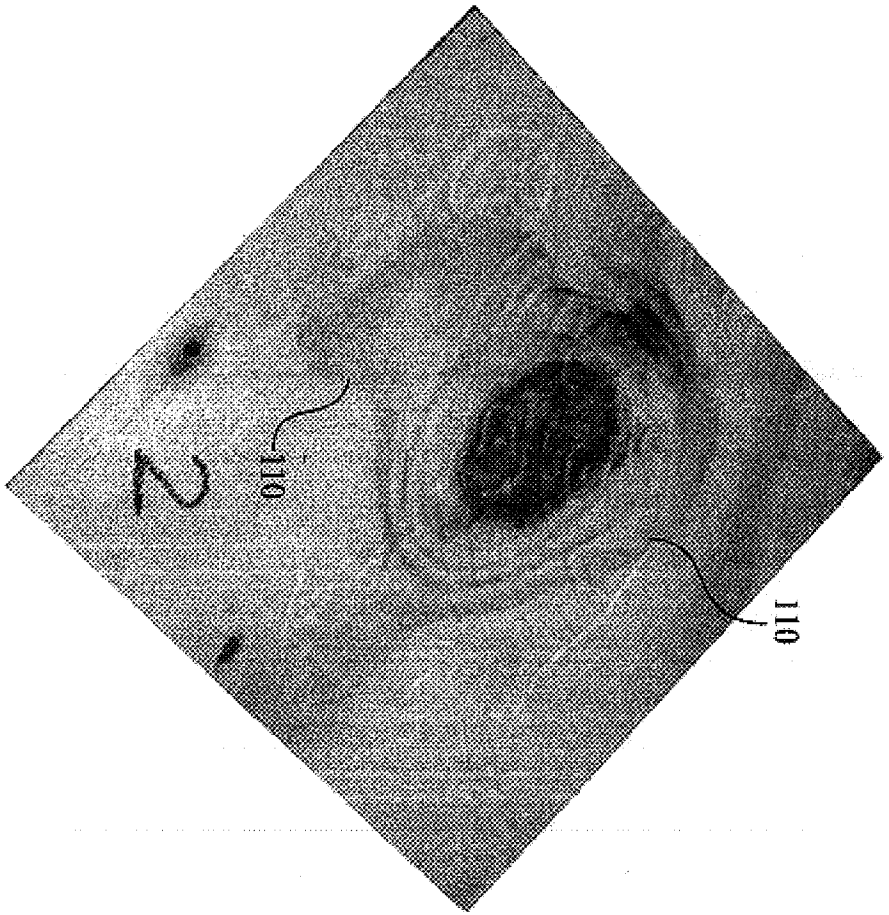
FIG. 2 shows the wood piece after trenching and cleaning.

After the trenching step, using a large rubber pencil eraser or other marking-removal device, the entire piece of wood should be rubbed down several times with and against the wood grain in order to remove all remaining pencil lines used to outline the shape or design (Step 5). The trenched areas 110 of the design are shown after trenching (Step 4) and cleaning (Step 5) in FIG. 2. During the erasing stage, if unable to remove the existing transfer technique, a #150 grit sand paper can be used to remove any remaining transfer marks. After this step, a clean but trenched design should remain, as depicted in FIG. 2.

Using a broad dry paintbrush or tack cloth, all of the remaining eraser fragments should be brushed off until wood is clean of all debris (Step 6). The wood is then preferably wiped down using a clean piece of dry cloth, or a hair dryer or air-blower. This additional cleaning step prepares the wood for sanding and burning.

After cleaning the entire piece of wood, the wood piece should be re-sanded using, for example, #150 sand paper either by hand or by using a sanding machine (Step 7). All fragments of raised wood that are left from the engraving process and any remaining pencil, print, copy or transfer marks should be removed at this stage taking particular note to sand raised areas that are not even with all other areas of the wood surface. Preferably, the sanding should always be made with (not against) the wood grain.

Figure 3:
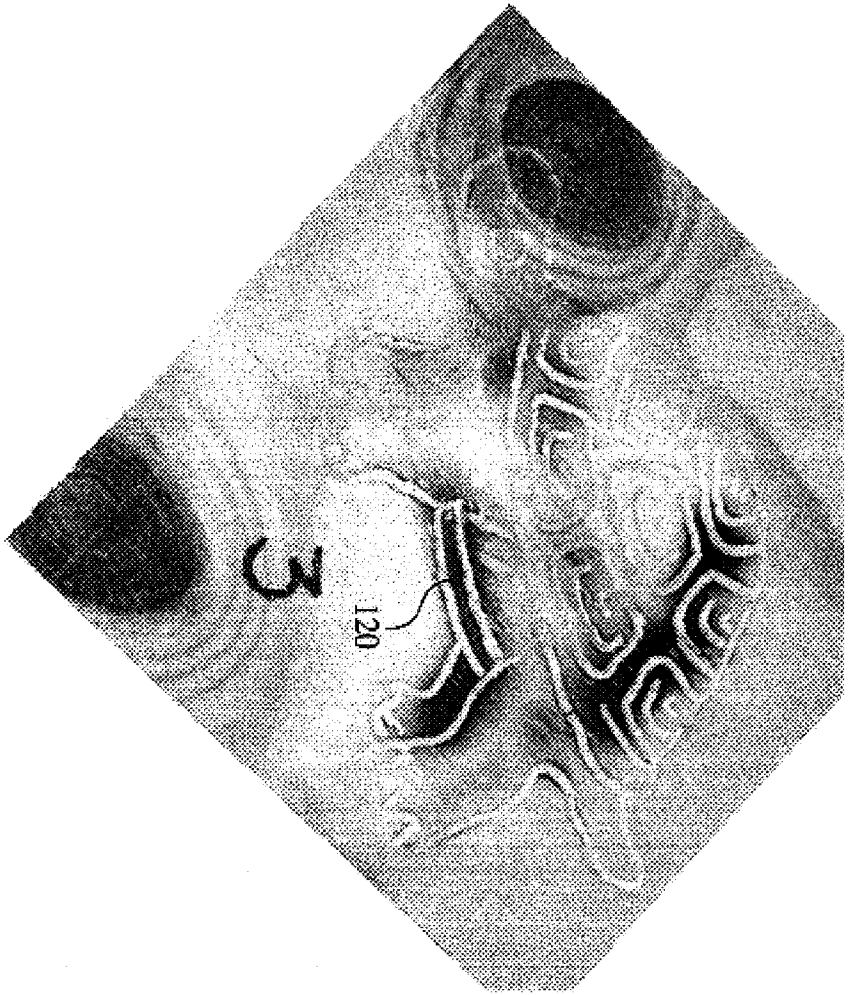
FIG. 3 shows the wood piece after darkening certain areas with a heating element.

Using a heating element (e.g., propane torch, soldering-iron or wood burning tool), heat from the element is applied directly to the areas of the design that are to be darkened, defined, shadowed or shaded (Step 8). FIG. 3 shows the exemplary turtle design after a heating step. Applying different amounts of heat for various amounts of time will impart different effects on the wood (generally higher heating temperatures and longer heating times will darken the wood to a greater degree).

If using a propane torch, a consistent distance and motion while implementing the burning technique should be maintained to provide a more effective and consistent application. The distance between the torch and the wood should be consistent in order to allow the operator to control how dark the wood is made. Holding the flame of the torch close to the surface of wood will darken the wood vary rapidly—turning the wood from its natural state to a dark ebony shade. Holding the flame of the torch at a greater distance from the work will allow the operator to gradually darken the wood to a desired shade, as depicted at 120 in FIG. 3.

Using a tack cloth, the operator next cleans the entire wood surface, that is now engraved and somewhat darkened, of dirt, dust or debris (Step 9). The surface of the wood should be cleaned of virtually all dirt, dust or debris in preparation for the wood staining process described below. The wood can also be treated with a wood sealer to provide a more even absorption of stain or varnish.

Figure 4:
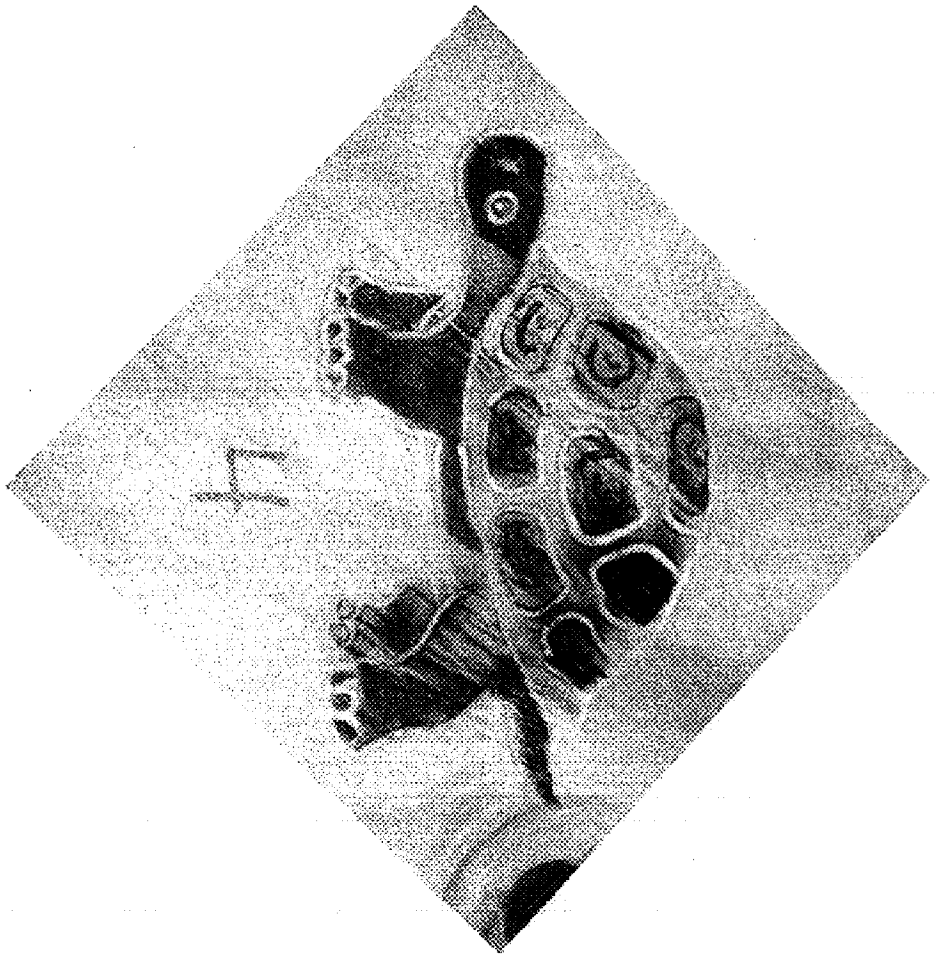
FIG. 4 shows the wood piece after an initial staining step.

Once the woodwork is free of all dirt, dust and debris, a wood stain, oils or varnish should be applied to the wood to add color and depth to work (Step 10). The stains, oils or varnish are preferably applied using a paintbrush or clean cloth or by using other known stain or paint application processes. These techniques are common in the woodworking arts. As with the sanding, the stains, oils, and/or varnishes are preferably applied in the direction of the wood grains. After allowing the stain, oils or varnish to set for 2 to 3 minutes, using a dry, clean cloth, all of the excess stain, oils or varnish should be removed by rubbing in the direction of the wood grains. After this process, the wood should appear as depicted in FIG. 4.

Figure 5:
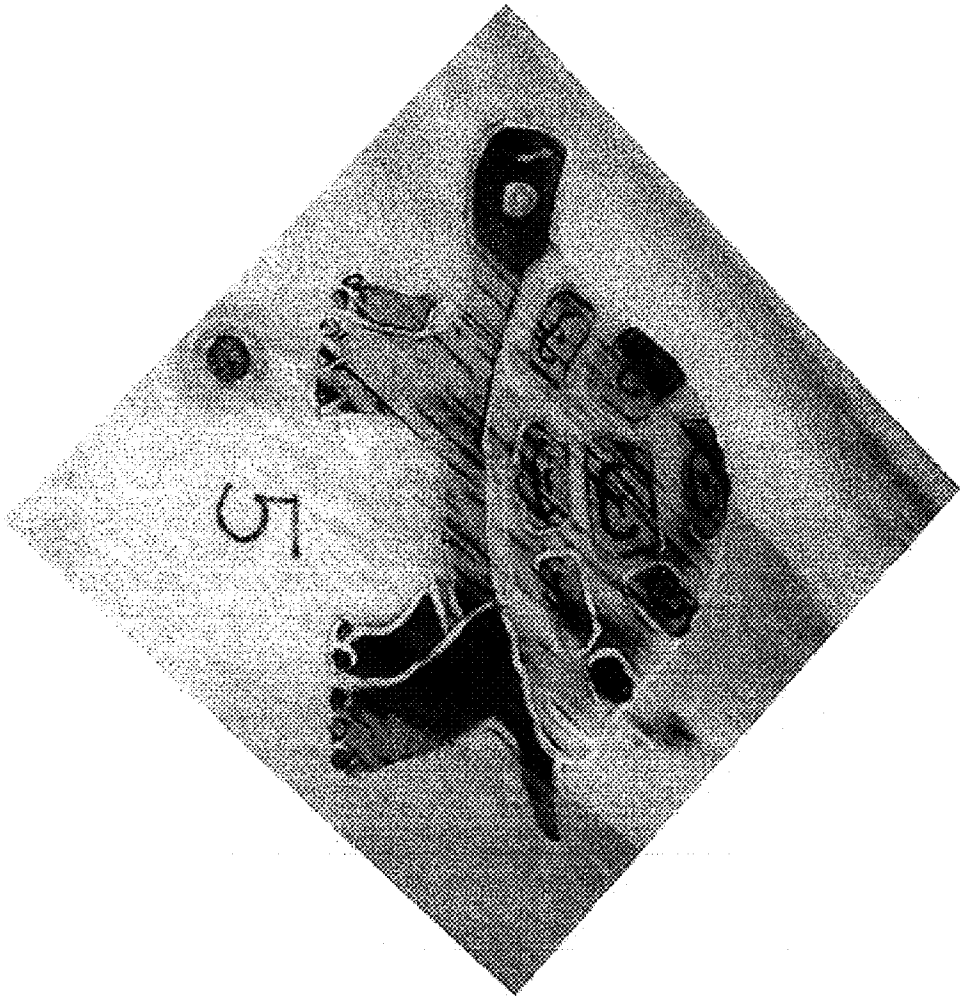
FIG. 5 shows the wood piece after a post-staining sanding process.

The stain or other material is then allowed to dry for approximately 8–24 hours depending on size of work and room temperature or as directed by the manufacturer's directions on the label of the stain, oil or varnish that is used (Step 11). Once the stain or other material has dried completely, the entire work is lightly sanded using, for example, #220 sand paper in the direction of the wood grain (Step 12). This light sanding process is preferably accomplished by hand, and the operator should ensure to sand any high areas created by the staining process, along with any areas that have collected too much of the stain, oil or varnish during staining process. FIG. 5 shows the results of this sanding process (Step 12).

The entire piece of wood is then once again wiped down with tack cloth in preparation for a repeat of the above processes (Step 13). If desired, Steps 10, 11 and 12 may be repeated to apply additional stain, varnish or other finish to the woodworking. Each time, the finish is applied and then wiped off, followed by a light sanding step. In one preferred embodiment, finish is applied and then sanded twice, and a third finishing step is followed only by rubbing and not sanding. In other words, the final time that finish is applied to the wood, it is preferably not sanded.

Figure 6:
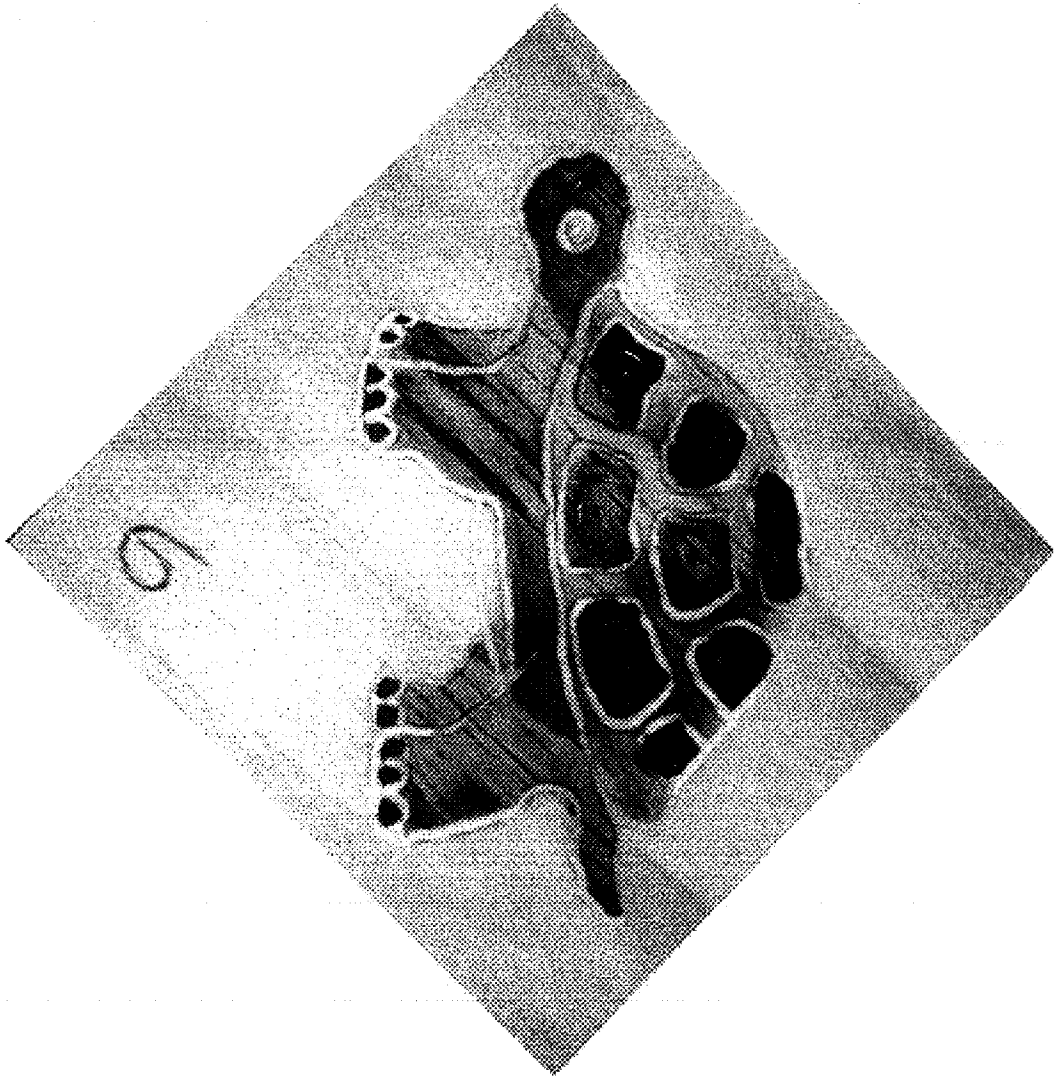
FIG. 6 shows a finished wood design without sealing.
Figure 7:
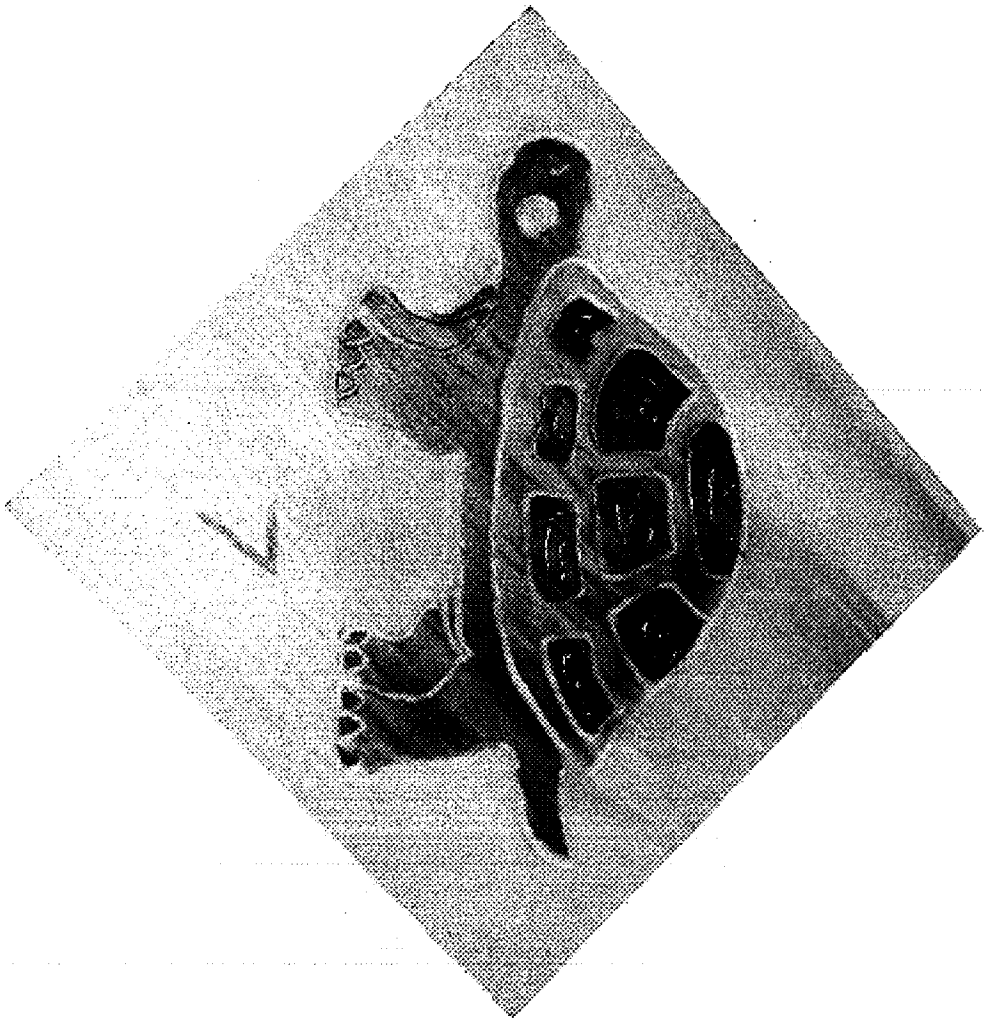
FIG. 7 shows a finished wood design with sealing (polyurethane).

(Step 14) After completing the final finishing and allowing it to dry according to the effect desired for the wood, the entire piece of wood should again be wiped down using a tack cloth to remove all of the dirt, dust or debris in preparation for a final sealer/polyurethane finishing step, if desired. For example, a wood sealer or polyurethane finish may be applied to protect the work from damp environments and conditions, but the work can also be presented without the polyurethane finish for an "earthy" look. If the sealer/polyurethane is used, the manufacturer's directions should be followed. A finished work without sealing is depicted in FIG. 6. A finished work with a layer of polyurethane is shown in FIG. 7.

As described above, the above method(s) may be used to create a unique aesthetically pleasing woodworking design. In general, common tools are used such as lead pencils (hard or soft), rubber erasers, clamps, paint thinners, engraving tools, a handheld sander and/or sandpaper, utility blades, stains, oils, varnishes, dry cloths or rags, heating elements (propane torch, soldering iron, and/or wood burning tool), paintbrushes, and woods such as oak, pine, birch and/or luana.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A method for creating a decorative wood carving, comprising the steps of:

selecting a porous piece of wood;

sanding at least a first broad surface of the wood;

transferring a design onto the first surface of the wood;

trenching said first surface according to the transferred design;

re-sanding the first surface after trenching to remove any remnants of said design;

applying heat to the first surface after trenching to darken at least some sections of said trenched surface; and applying a finish to said first surface after heating.

2. The method of claim 1, wherein said piece of wood is selected from the group consisting of oak, pine, birch, and luana.

3. The method of claim 1, wherein said step of sanding at least a first broad surface of the wood includes sanding two opposing broad surfaces of the wood.

4. The method of claim 1, wherein said transferring is accomplished by directly drawing the design on said first surface with a soft lead pencil.

5. The method of claim 1, wherein said transferring is accomplished using a stencil.

6. The method of claim 1, wherein said transferring is accomplished using a rub transfer.

7. The method of claim 1, wherein said trenching is accomplished using a chisel.

8. The method of claim 1, wherein said trenching is accomplished using a utility knife.

9. The method of claim 1, wherein said trenching is accomplished using a routing tool.

10. The method of claim 1, wherein said trenching is no deeper than about 2 centimeters in depth.

11. The method of claim 1, wherein said finish is a stain.

12. The method of claim 1, wherein said finish is a varnish.

13. The method of claim 1, further comprising the steps of:

after said step of applying a finish, allowing the finish to dry for 2–3 minutes;

removing excess finish with a cloth; and using sandpaper to smooth said first surface.

14. The method of claim 13, further comprising the steps of:

after said step of using sandpaper to smooth said first surface, applying a second finish to the first surface;

allowing the second finish to dry for 2–3 minutes;

removing excess second finish with a cloth; and using additional sandpaper to smooth said first surface.

15. The method of claim 14, further comprising the step of:

applying a final polyurethane finish to said first surface.

16. The method of claim 1, further comprising the step of:

applying a final polyurethane finish to said first surface.

17. A method for creating a decorative wood carving, comprising the steps of:

selecting a porous piece of wood;

sanding at least a first broad surface of the wood;

using a soft pencil to draw a design onto the first surface of the wood;

trenching said first surface by following the penciled design;

re-sanding the first surface after trenching to remove any remnants of said design;

applying heat to the first surface after trenching to darken at least some sections of said trenched surface;

re-sanding said first surface after said step of applying heat;

applying a finish to said first surface after heating;

allowing the finish to dry for 2–3 minutes;

removing excess finish with a cloth; and using sandpaper to smooth said first surface.

18. The method of claim 17, further comprising the step of:

applying a final polyurethane finish to said first surface.

19. The method of claim 17, wherein said finish is a stain.

20. The method of claim 17, wherein said finish is a varnish.

* * * * *